United States Patent [19]

Kambic

[11] Patent Number: 4,685,709

[45] Date of Patent: Aug. 11, 1987

[54] DEADLOCKED LATCH HAVING DISC AND MOTOR ACTUATORS

[75] Inventor: Raymond V. Kambic, Joliet, Ill.

[73] Assignee: R. R. Brink Locking Systems, Inc., Plainfield, Ill.

[21] Appl. No.: 614,982

[22] Filed: May 29, 1984

[51] Int. Cl.[4] ..... E05B 47/00

[52] U.S. Cl. ..... 292/201; 70/279; 70/282; 70/DIG. 42; 292/DIG. 62; 307/119; 340/542

[58] Field of Search ..... 70/271, 277, 279, 282, 70/283, DIG. 42; 292/201, 124, 224, DIG. 62, 222, 210, 108, 144, 196; 307/119, 120; 340/542

[56] References Cited

U.S. PATENT DOCUMENTS

| | | | |
|---|---|---|---|
| 3,142,166 | 7/1964 | Adam et al. | 70/282 |
| 3,157,042 | 11/1964 | Wolz | 70/282 |
| 3,799,592 | 3/1974 | Babb, Jr. et al. | 292/169.15 X |
| 3,999,411 | 12/1976 | Kambic | 70/144 |
| 4,126,341 | 11/1978 | Bradstock | 292/201 |
| 4,180,287 | 12/1979 | Youngblood et al. | 292/144 |
| 4,237,711 | 12/1980 | Kambic | 70/432 X |
| 4,429,556 | 2/1984 | Kambic | 70/149 |
| 4,434,635 | 3/1984 | Borgato | 292/201 X |
| 4,452,058 | 6/1984 | Noel | 292/201 X |
| 4,509,347 | 4/1985 | Young | 70/279 X |

FOREIGN PATENT DOCUMENTS

| | | | |
|---|---|---|---|
| 10132 | of 1892 | United Kingdom | 292/197 |
| 1572366 | 7/1980 | United Kingdom | 292/169.13 |

*Primary Examiner*—Robert L. Wolfe
*Assistant Examiner*—Lloyd A. Gall
*Attorney, Agent, or Firm*—Trexler, Bushnell, Giangiorgi & Blackstone, Ltd.

[57] ABSTRACT

A locking system comprises a lock mechanism including a casing structure adapted to be mounted to one of a door and a door frame and having a front plate with an aperture therein; a latch bolt mounted with respect to the casing structure for movement between a first position wherein a portion thereof extends from the front plate of the casing structure for latching engagement with the other of the door and door frame, and a second, retracted position wherein the same portion thereof is held out of position for said latching engagement. A deadlock member is mounted to the casing for movement between a blocking position wherein the deadlock member will prevent movement of the latch bolt to the second, retracted position, and a non-blocking position wherein the latch bolt is free to move to the retracted position. An operating disc is rotatably mounted coaxially with the latch bolt and coupled to rotate the latch bolt through a lost motion type of connection. A control system is provided for effecting selective rotatable movement of the operating disc to move the latch bolt to the retracted position, with the initial rotation of the operating disc resulting in the movement of the deadlock member to the non-blocking position, and with the lost motion connection delaying movement of the latch bolt until the deadlock is moved from the blocking position.

37 Claims, 12 Drawing Figures

FIG. 1
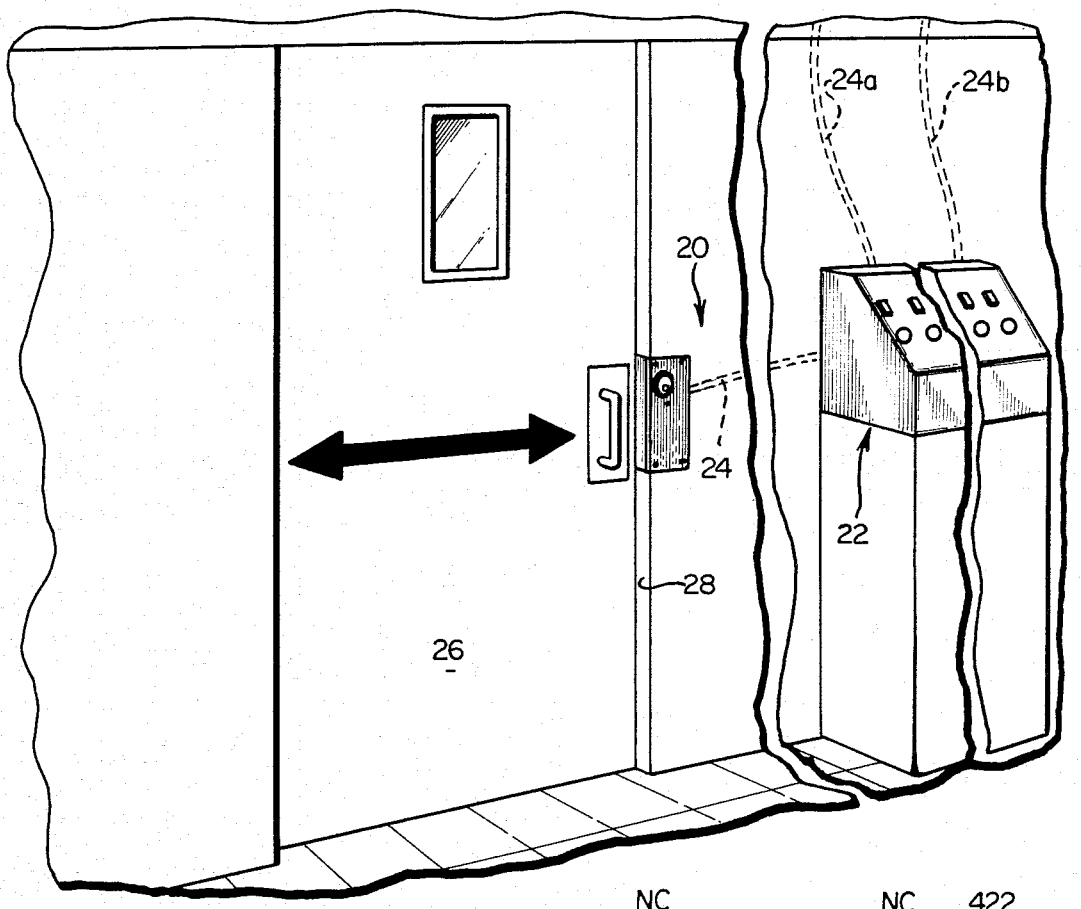
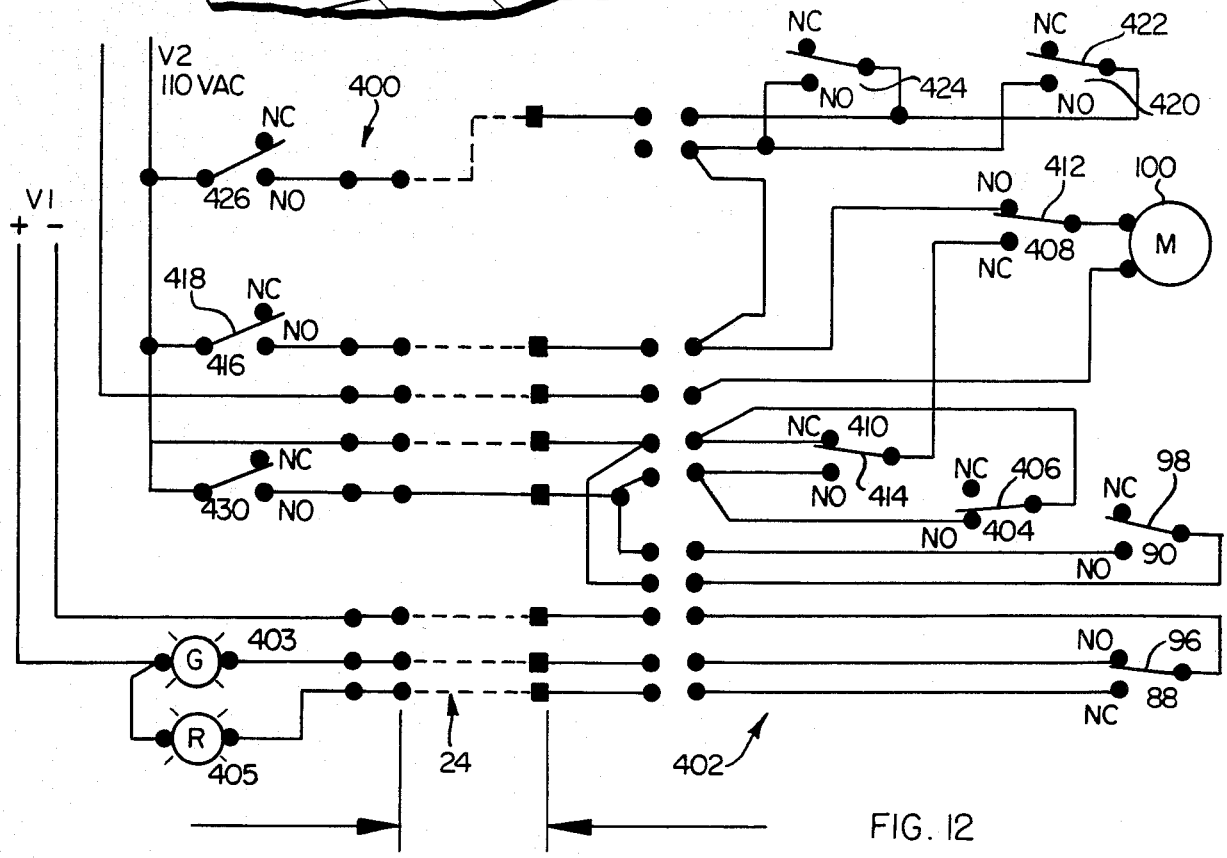
FIG. 12

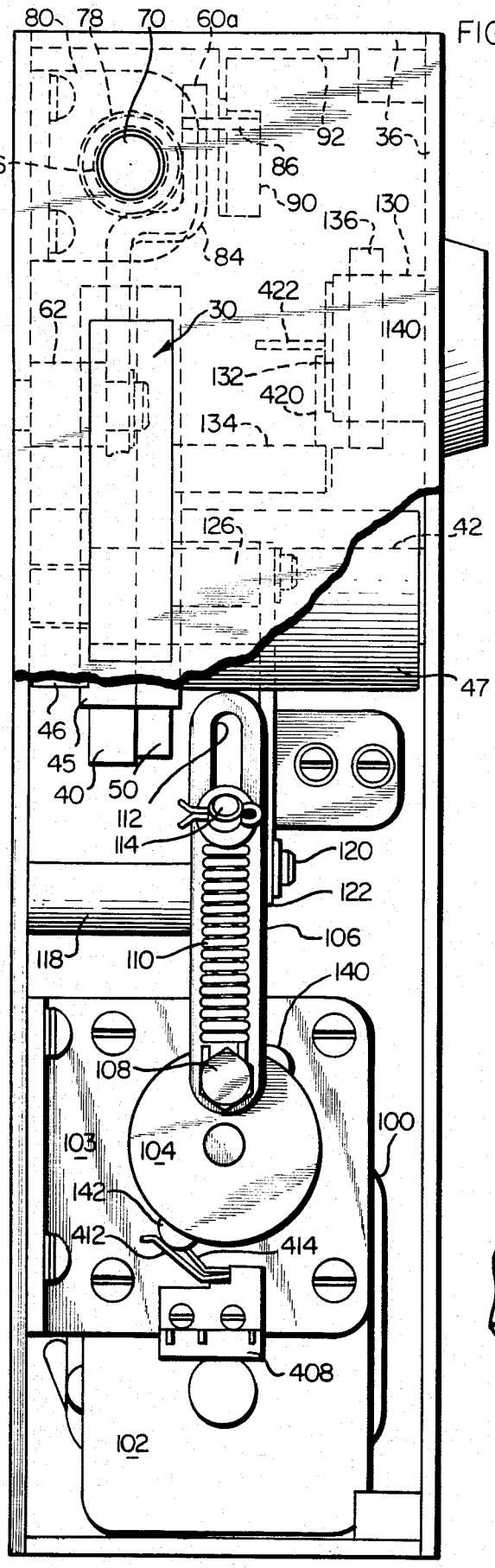
FIG. 3
FIG. 4
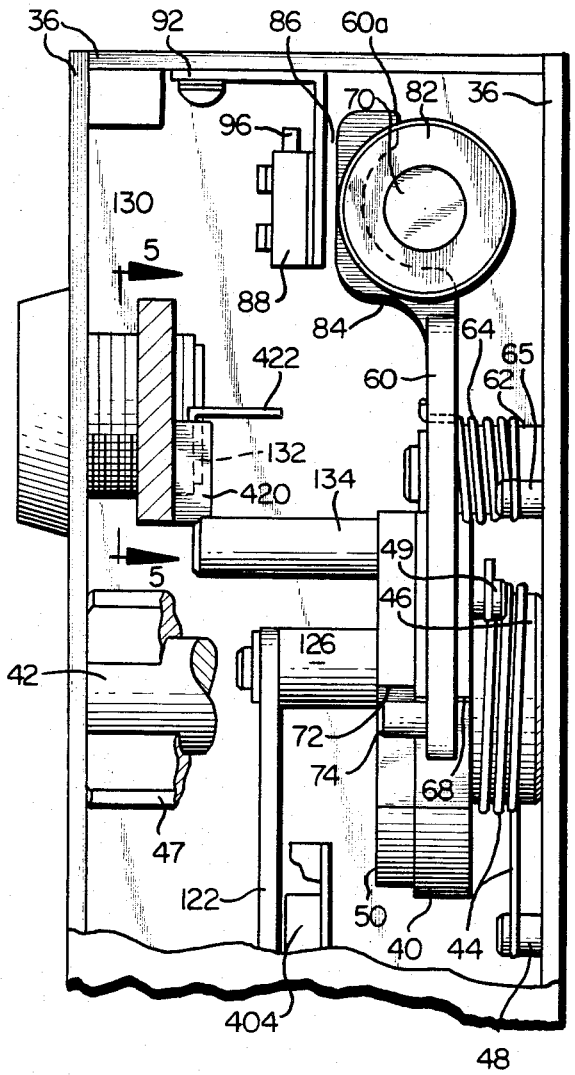
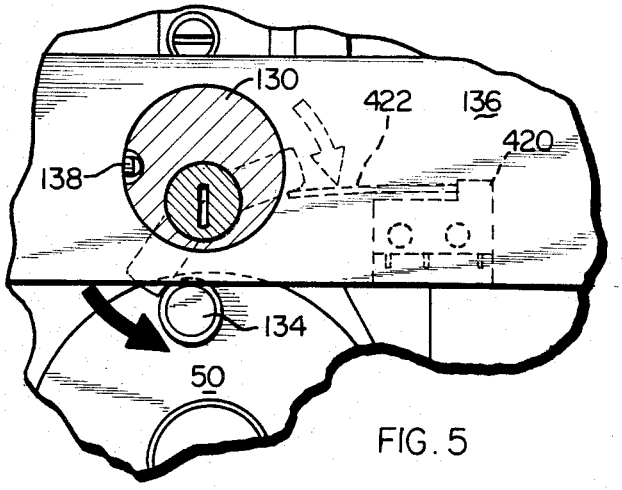
FIG. 5

DEADLOCKED LATCH HAVING DISC AND MOTOR ACTUATORS

BACKGROUND OF THE INVENTION

The present invention relates to a remotely controlled locking system, including a lock mechanism for mounting to a door or a door frame, wherein the door will control access to a secured area.

There are many instances wherein it is desireable to control access to a secured area by means of a lock mechanism used on the door leading to the area. For example, modern penal institutions of the medium to high security type employ monitoring and control apparatus for cell doors. This is done to provide security for the guards, as well as for the individual inmates, as it is necessary to control door operations so as to both control the number of doors open at any one time as well as to monitor which doors are open and which doors are locked. In such systems, the doors may be controlled electrically from a remotely located control panel, accessible only to authorized personnel.

The correction officers will additionally have a master key which can mechanically unlock any door, with each inmate being issued an individual key capable of permitting the unlocking of his cell door from the exterior of the cell. Inside the cell, a push-button may be provided which can operate the cell lock enabling the prisoner to exit the cell. However, the ability of the prisoner to operate the door from either the exterior or interior is also controlled by the control panel, and as such each cell door lock can be rendered operable or inoperable by the prisoner at the election of the correction officer. To attain the desired monitoring and control of the status of each cell door and its locking mechanism, the present invention utilizes novel electrical means which are responsive to door position and to the position of selected elements of the locking mechanism for providing suitable control signals in relation thereto.

The basic structural elements of most lock mechanisms do not vary to a great extent, in that these mechanisms normally include some form of latch or latch bolt member, an external operating member such as a key-operated cylinder that is coupled for relative movement with respect to the lock mechanism, and various internal cams and/or link members for converting movement of the operating member into operation of the latch member. Additionally, such lock mechanisms often include some additional deadlock or blocking means internally which is engageable with one or more other internal members to prevent normal movement for unlocking or unlatching of the latch or latch bolt member. Such lock mechanisms may also be controlled by electrically operated means, such as a solenoid located within the lock mechanism and operated electrically from the remotely located control panel mentioned above. One example of this type of control can be found in the inventor's prior U.S. Pat. No. 4,237,711, issued Dec. 9, 1980, and entitled LOCK MECHANISMS, and in the inventor's prior U.S. Pat. No. 4,429,556, issued Feb. 7, 1984, and entitled LOCK MECHANISM.

While the specific prior art arrangements discussed above have proven satisfactory for numerous uses, there is yet room for further improvement. While useful in other types of installations, the present invention is particularly advantageous in conjunction with sliding door-type installations. In this regard, the disclosure of the present invention will be facilitated by reference to a lock of the type having a rotatably or pivotally mounted latch bolt for latching and unlatching either a door or door frame in such a sliding door type of installation. In this type of operation, it will be appreciated that when the door is open, at least a portion of the latch bolt will be accessible.

Moreover, many such installations are provided with a deadlock trigger mechanism, a portion of which is also accessible when the door is open, which normally controls operation of the deadlock mechanism discussed briefly above. As such, one trying to override the remotely controlled operation of the lock may attempt to do so by depressing the deadlock trigger into the position which it normally assumes when the door is closed. This may also be done in an effort to override the normal monitoring of door and lock position.

Similarly, when trying to override the remotely controlled electrical operation of the latch bolt, one may place considerable force on the latch itself and correspondingly upon the internal mechanism of the lock, and especially the electrical operating components. This force may become extensive enough to override or cause stalling of the electrical operating or drive components, resulting either in damage to the internal lock and drive components, or in improper indication to the correction officer of proper operation of the lock, when in fact such proper operation has been prevented.

Advantageously, the present invention utilizes novel internal components for preventing such overriding of lock operation. Moreover, the invention provides additional novel internal electrical monitoring and control components for assuring both desired operation of the lock and proper monitoring of the condition of the lock at all times.

As will be discussed more fully with reference to the detailed description and drawings which follow, there are shown several specific embodiments of the present invention. In the first embodiment, the overall lock control arrangement utilizes an electric motor for effecting operation of the lock. In a second embodiment, a solenoid is utilized in place of the electrical motor of the first embodiment. In conjunction with this second embodiment, the solenoid and internal lock structure may be constructed and assembled for either "fail-safe" or "fail-secure" operation as desired. More specifically in this regard, the solenoid and related internal lock mechanism may be of the type such that upon disruption of power, whether intentionally or due to power failure, the lock will automaticaly be placed in an open condition, thus achieving a "fail-safe" condition. On the other hand, the arrangement may be such that upon disruption of power, the lock will be placed in a latched or locked condition, thereby rendering the unit "fail-secure".

BRIEF DESCRIPTION OF THE DRAWINGS

The foregoing, as well as other advantages and features of the invention will become apparent from the following detailed description of the illustrated embodiment, together with reference to the accompanying drawings, in which like reference numerals identify like elements, and in which:

FIG. 1 is a perspective view, somewhat in diagrammatic form, illustrating a sliding door installation in conjunction with which a locking system in accordance with the invention is utilized;

FIG. 3 is a side elevation, partially broken away and taken generally in the plane of the line 3—3 of FIG. 2;

FIG. 4 is a partial side elevation, partially broken away and taken generally in the plane of the line 4—4 of FIG. 2;

FIG. 5 is a fragmentary view taken generally in the plane of the line 5—5 in FIG. 4;

FIG. 12 is a circuit schematic diagram illustrating a novel electrical circuit for monitoring and control of the lock mechanism of the invention.

DETAILED DESCRIPTION OF THE ILLUSTRATED EMBODIMENT

Figure 2:
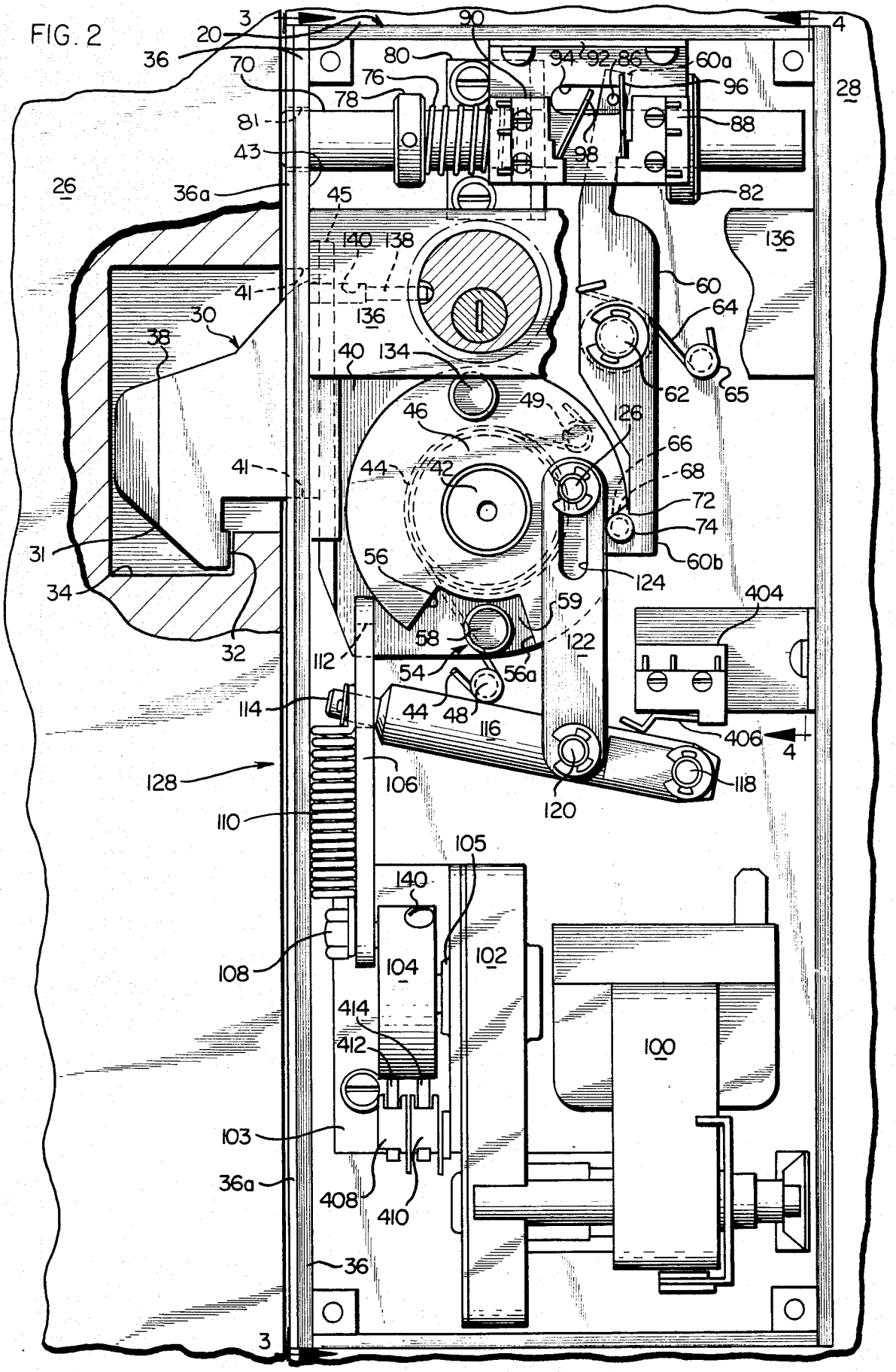
FIG. 2 is an enlarged side elevation, partially broken away, illustrating details of a lock mechanism in accordance with the invention installed with a door and door frame, illustrating the door in a closed condition and the lock mechanism in a fully latched or locked condition.

Referring now to the drawings, and initially to FIGS. 1 through 5, one form of lock or lock mechanism 20 in accordance with the invention is illustrated. In FIG. 1, this lock or lock mechanism 20 will be seen to be part of a locking system in accordance with the invention, which locking system further includes a remotely located control panel 22. This control panel 22 is operatively coupled with the lock 20 by means of a suitable cable 24. A plurality of such cables 24*a*, 24*b*, etc. couple the control panel to further locks similar to the lock 20 so that a plurality of such locks may be controlled from the single control panel 22, for example by an authorized security guard, correction officer or the like.

The lock 20 is associated with a door 26 and door frame 28. In the illustrated embodiment, the lock 20 is illustrated mounted to the frame 28 for locking and unlocking door 26, which in the illustrated embodiment comprises a sliding door. In this regard, the lock mechanism 20 includes a latch or latch bolt member 30 (see FIG. 2) which has a generally hook-shaped portion 32 for coupling with a complementary formed locking aperture 34 in the door 26. Latch bolt 30 also has a tapered leading edge 31 to facilitate initial engagement with aperture 34 for latching. It will be appreciated that the lock mechanism 20 may be mounted to the door 26 for engagement of a similar aperture 34 forming a part of the frame 28 without departing from the invention. Moreover, the present invention may find utility with a swinging type of door as well as the sliding door illustrated in FIG. 1, and which is utilized in the drawings herein to exemplify the utility of the invention.

The construction and operation of the lock mechanism 20 will now be considered with reference to FIGS. 2 through 8. Initially, the lock mechanism 20 includes a casing structure 36 which in the illustrated embodiment is fabricated from a series of separate components and is adapted for mortise mounting in the door frame 28. The latch bolt 30 includes an exterior or end portion 38 which extends outwardly from the casing structure 36 at a through aperture 41 which also extends through a face plate 36*a*. The previously mentioned hook-like engaging portion 32 and surface 31 for engagement with aperture 34 are located on this end portion 38. The latch bolt 30 further includes an interior portion 40 which in the illustrated embodiment is pivotally or rotatably mounted to a shaft 42. Moreover, the latch bolt is normally biased to rotate or pivot toward the latched position illustrated in FIG. 2, that is in a generally counter-clockwise direction as illustrated in FIG. 2. In this regard, an upwardly extending stop member 45 of interior portion 40 engages an interior wall surface 43 of the casing structure 36 adjacent a top edge of aperture 41 to define the fully extended or latched position of the latch bolt 30.

This biasing is accomplished in the illustrated embodiment by means of a coil spring 44 which is coiled about an enlarged bolt support bushing 46 which abuts and supports one side surface of the latch bolt interior portion 40 as best viewed in FIG. 4. This bolt support bushing 46 also surroundingly supports the latch bolt mounting shaft 42 which is surroundingly supported at its opposite end by a similar bushing 47. The coil spring 44 has respective ends thereof engaged with a pin 48 affixed to a wall of the casing structure 36 and with a second pin 49 which is affixed to and protrudes axially from a facing surface of the latch bolt interior portion 40.

The latch bolt is movable against the biasing force of the spring 44 into a second, retracted or unlatched position, wherein the exterior portion 38 is held out of position for latching engagement with the aperture 34 of the door 26. It will be noted that the spring bias 44 and leading tapered end 31 normally facilitate engagement and latching of the latch bolt end 38 with aperture 34.

An operating disc 50 comprises a generally circular disc-like member which is rotatably mounted coaxially with the latch bolt on the shaft 42, and in the illustrated embodiment, abutting a facing surface of the interior portion 40 thereof. In this regard, the interior portion 40 of latch bolt 30 will be seen to comprise a generally flat and substantially semi-circular surface for abutment with the operating disc 50. Additionally, the shaft supporting bushing 47 extends to the opposite or facing surface of the operating disc 50, whereby the latch bolt 30 and operating disc 50 are held securely but rotatably on shaft 42 intermediate the support member 46 on the one side and the support member 47 on the other side.

The operating disc 50 is also coupled to rotate the latch bolt 30 through a lost motion type of connection indicated generally at reference numeral 54. This lost motion connection in the illustrated embodiment comprises an arcuate cut-away or slot 56 formed on the periphery of the operating disc 50 and a cooperating axially outwardly projecting pin 58 mounted to the facing surface of interior portion 40 of the latch bolt 30. It will be noted that in the embodiment illustrated in FIGS. 2–8 the disc is adapted for rotating the latch bolt 30 to the retracted or unlatched position only, it being recalled that the spring 44 normally acts to return the latch bolt 30 to the latch position. In this regard, a trailing surface 56*a* of the cut-out or slot 56 engages the pin 58 for rotating the latch bolt 30 to the unlatched position when the disc is rotated in the clockwise direction as viewed in FIG. 2. However, when the disc is rotated in the opposite or counter-clockwise direction, the pin 58 and hence latch bolt 30 will be free to rotate or pivot back to the latched position under the influence of the spring 44.

The above-mentioned lost motion connection will be seen with reference to FIG. 2 wherein all the structures of the locking mechanism are illustrated in a fully latched or locked position. In this position, it will be noted that a gap or space 59 remains between the surface 56*a* of the cut-out 56 and the facing surface of the pin 58. Hence, upon revolution in the clockwise direction of the disc 50, for opening the latch bolt 30, the disc must advance this distance 59 before initially engaging the pin 58 for initial movement or rotation of the latch bolt in the direction for unlatching.

In this regard, a deadlock member in the form of an elongate lever member 60 is also mounted to the casing 36 for movement between a blocking position wherein the deadlock member 60 will prevent movement of the latch bolt to the retracted or unlatched position and a non-blocking position wherein the latch bolt is free to move to the retracted or unlatched position. In the illustrated embodiment, this deadlock member or lever 60 is mounted for pivotal or rotatable motion generally at the mid-point thereof by a shaft 62. The deadlock lever is normally biased for pivotal motion generally in the clockwise direction, as viewed in FIG. 2, by a coil spring 64 which is placed about the shaft 62 and has one end engaged with a further pin 65 coupled to the casing structure 36, the opposite end thereof being hooked about an opposite edge surface of the lever 60. A first end portion 60*a* of the deadlock lever 60 is associated with a deadlock trigger or trigger bolt or member 70 to be described later. The second or opposite end 60*b* of the deadlock lever 60 is operatively associated with the latch bolt 30. In this regard, this latter end 60*b* includes an acutely angled hook-like portion forming a blocking, deadlock or stop surface 66 which engages a complementary acutely angled blocking, deadlock or stop surface 68 formed at a rear edge of the interior portion 40 of latch bolt 30. The engagement of these two surfaces 66 and 68 accomplishes the deadlock function and defines the above-mentioned blocking position wherein the deadlock or lever 60 prevents movement of the latch bolt to its retracted or unlatched position.

The operating disc 50 will be seen to further include a camming surface 72 which comprises a generally angled surface located generally adjacent and somewhat leading the deadlock or blocking surface 68 of the coaxially mounted latch bolt 30. A cooperating cam follower in the form of a circular pin or roller 74 is mounted to the end 60*b* of the deadlock lever 60 and is just in contact with this camming surface 72 when the assembly is in the fully latched or locked position as illustrated in FIG. 2. In this regard, FIG. 2 illustrates the blocking position of the deadlock member 60.

Accordingly, and referring again to the gap or space 59 defined by the lost motion connection 54, it will be seen that initial rotatable movement of the operating disc to move the latch bolt to the retracted or unlatched position will result in camming or pushing back of the deadlock member by the action of the camming surface 72 as it rotates generally in the clockwise direction against the cam follower or roller 74. Hence, the deadlock lever 60 and its blocking or deadlock surface 66 will be rotated or cammed in a generally counter-clockwise direction as viewed in FIG. 2 for disengagement from the blocking or deadlock surface 68, and against the biasing action of the spring 64. The gap 59 of the lost motion connection 54 is sufficient to allow this camming out of the deadlock lever, prior to engagement of surface 56*a* with pin 58 for initiating rotation of the latch bolt 30 toward the unlatched or retracted position. Hence, the lost motion connection delays movement of the latch bolt by the disc until the deadlock is moved from the blocking position. Thereafter, the disc may rotate the latch bolt to the retracted or unlatched position, as shown for example in FIG. 6.

It will be noted that the axis of rotation of both the latch bolt 30 and operating disc 50 and the pivot axis defined by shaft 62 of the deadlock lever 60 are located in parallel planes and also parallel to the front plate 36*a* of casing structure 36.

Reference is now again directed to the first or upper end 60*a* of the deadlock lever 60 and the trigger bolt or member 70. It will be seen that this trigger member or deadlock trigger is biased and mounted for movement with respect to the casing structure front plate 36*a* between a retracted position as shown in FIG. 2, when the door 26 is closed, and an extended position as shown for example in FIG. 7, when the door is open. The biasing toward the extended position is generally provided by a coiled compression spring 76 which is mounted surrounding the generally cylindrical deadlock trigger 70 and held compressed between a first sleeve 78 also mounted to the deadlock trigger 0 and a guide bracket 80 which supports the deadlock trigger 70 for slideable movement. A second through aperture 81 is provided in the casing structure 36 and front plate 36*a* to accommodate the deadlock trigger 70.

The deadlock trigger 70 mounts a second sleeve 82 at an end portion generally opposite the mounting of sleeve 78 as viewed in FIG. 2. This latter sleeve 82 is positioned to engage the first or upper end 60*a* of the deadlock lever 60 when the trigger 70 is in the extended position so as to pivot the opposite or second end 60*b* of the deadlock lever 60 to the non-blocking position with respect to latch bolt 30. On the other hand, movement of the trigger to the retracted position as illustrated in FIG. 2, for example when the door 26 is closed, frees the deadlock lever for movement by the spring biasing action of spring 64 back toward the blocking position. In this regard, it will be recognized that the lower end 60*b* of deadlock lever will reach the locking position only if the disc 50 and bolt 30 are rotated substantially to the latched position illustrated in FIG. 2 to permit engagement between the surfaces 66 and 68 as described above. It will be additionally appreciated in this regard that the compressive force on spring 76 tending to urge the trigger to the extended position is more than sufficient to overcome the generally opposing force of coil spring 64 tending to hold the deadlock lever in the blocking position.

Referring briefly also to FIGS. 3 and 4, it will be seen that the upper end 60*a* of the deadlock lever 60 has a generally yoke-like shape as indicated at 84 for partially surrounding the trigger 70 in non-interfering condition and for engagement with the sleeve 82. Moreover, this yoke-like portion 84 extends generally to the left-hand side of the trigger 70 as viewed in FIG. 4 and mounts a generally laterally outwardly extending pin 86 for actuating one or the other of a pair of switches 88 and 90, which are mounted to a bracket 92 coupled to a top surface of the casing structure 36. This bracket 92 is provided with an elongate through aperture 94 through which the switch-actuating pin 86 extends for engagement with one or the other of movable contactors 96 and 98 of the respective switch 88 and 90. As will be seen later, the switches 88 and 90 comprise a portion of switching means carried by the casing and adapted for use with a monitoring circuit, or the like, to provide an indication of the condition of the lock mechanism 20. In this regard, the switch 88 is positioned to be operated by the deadlock lever 60 for providing an indication of whether the deadlock lever is in the blocking or non-blocking position.

In accordance with a further aspect of the invention, control means are provided for effecting selective rotatable movement of the operating disc 50 to move or rotate the latch bolt 30 to the retracted or unlatched position. In the embodiment illustrated in FIGS. 2 through 9, the control means includes remotely controlled means or electrical drive means comprising a motor 100 mounted in the casing and operatively coupled for rotating the operating disc 50. Other drive means, such as a rotary-type solenoid (not shown) may also be used.

Figure 6:
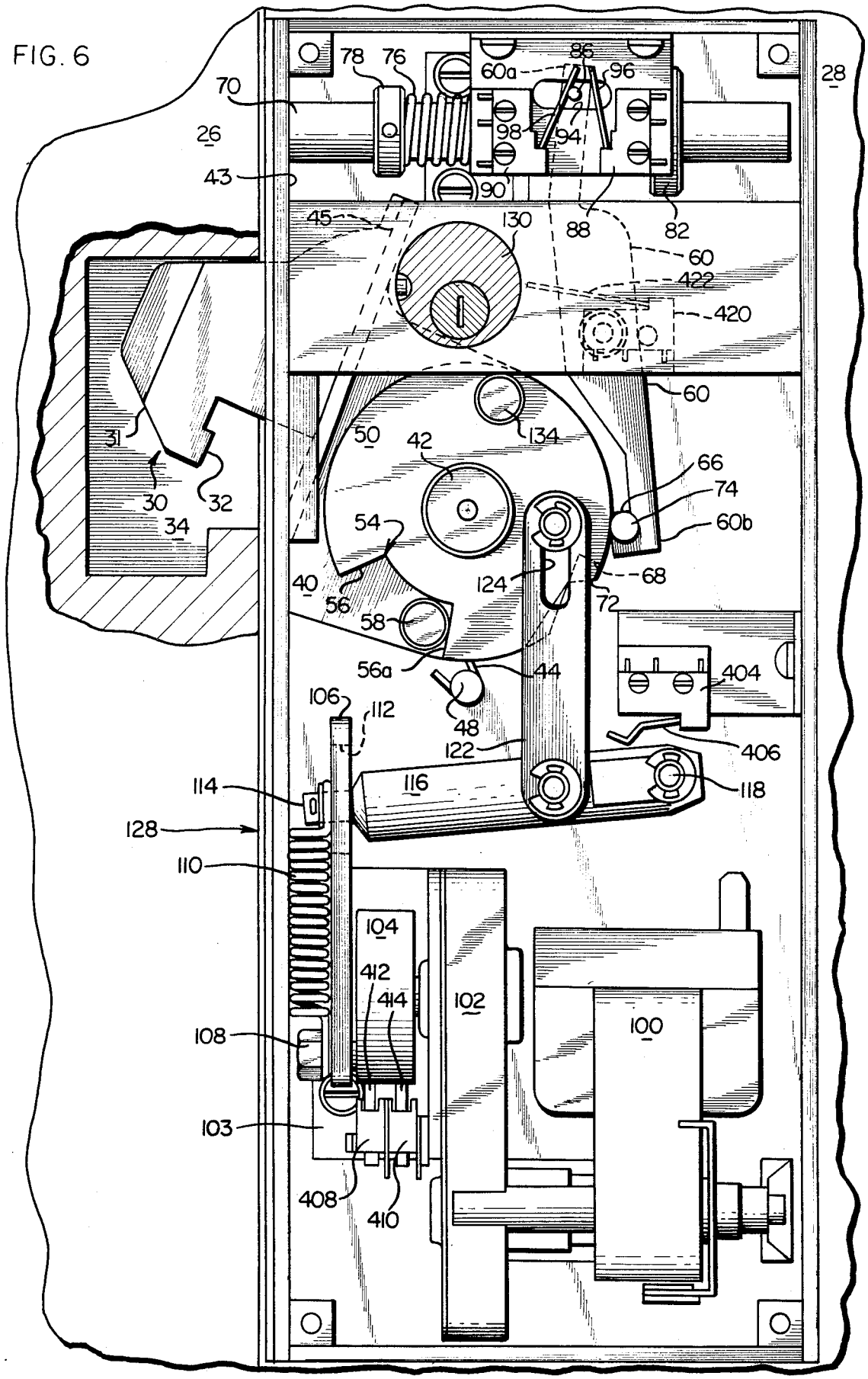
FIG. 6 is a view similar to FIG. 2 and illustrating the lock in an unlatched or unlocked position, with the door still in the closed condition.

This motor 100 is operatively associated with an electrical control circuit including a first circuit portion, which includes the previously described switch 90, mounted within the casing structure and a second circuit portion, which is mounted in the control panel 22 of FIG. 1 at a remote control or security location. The electrical drive means or motor 100 is responsive to predetermined signal conditions from the first and second circuit portions for rotating the operating disc 50. In this regard, the drive means is operative for rotating the disc 50 in generally the clockwise direction as viewed in FIG. 2 to achieve the retracted or unlatched position of the latch bolt 30 as shown in FIG. 6. However, when the motor is rotated to the position illustrated in FIG. 2, the operating disc and latch bolt 30 are free to move back to the latched or first position illustrated in FIG. 2, under the influence of the biasing coil spring 44 as previously described. Hence, the motor and other drive means of FIGS. 2–8 functions to initially rotate and thereafter hold the latch bolt 30 in the unlatched or retracted position.

In the embodiment illustrated in FIGS. 2–8, the motor 100 drives a suitable gear assembly or gear box 102 for transmitting torque and rotative motion to a cam or cam member 104 which in the illustrated embodiment is a substantially right cylindrical disc-like member. Preferably, an enlarged stabilizing and mounting bracket 103 is also provided for receiving and supporting a shaft bearing portion 105 of the gear box or gear assembly 102. The cam 104 mounts, at a point radially offset from its center, one end of a first elongate link member 106 which is coupled thereto by suitable means such as a screw or bolt 108. Also held by this screw or bolt 108 is one end of a tension spring member 110. The opposite end of first elongate link member 106 is provided with an elongate through opening or slot 112 which receives therein a first reduced diameter end portion 114 of an operating lever 116.

The opposite or upper end of spring 110 as viewed in FIGS. 2 and 3 is coupled to the reduced diameter end 114 of the operating lever 116. The opposite end of operating lever 116 is pivotally or rotatably mounted to a fixed pin or shaft 118 which is mounted to a rear wall of the casing 36 as viewed in FIG. 2. An intermediate portion of the operating lever 116 carries a further pin 120 to which is pivotally mounted a first end of a second link or linkage member 122. The opposite end of this link or linkage 122 is provided with an elongate through opening or slot 124 which surroundingly and rotatably engages a pin 126 which is rigidly mounted in an axially outwardly extending fashion from the operating disc 50. In operation, then, it will be seen that as the motor 100 rotates the cam 104 to a position substantially 180 degrees removed from that shown in FIG. 2, for example as shown in FIG. 6, a linkage assembly or link means designated generally 128, which includes the links 106 and 122, the operating lever 116 and the spring 110 as just described, rotates the operating disc 50 in the clockwise direction as viewed in FIG. 2, initially camming back the deadlock lever to its non-blocking position and thereafter rotatably or pivotally moving the latch bolt 30 to its retracted or unlatched position.

Figure 11:
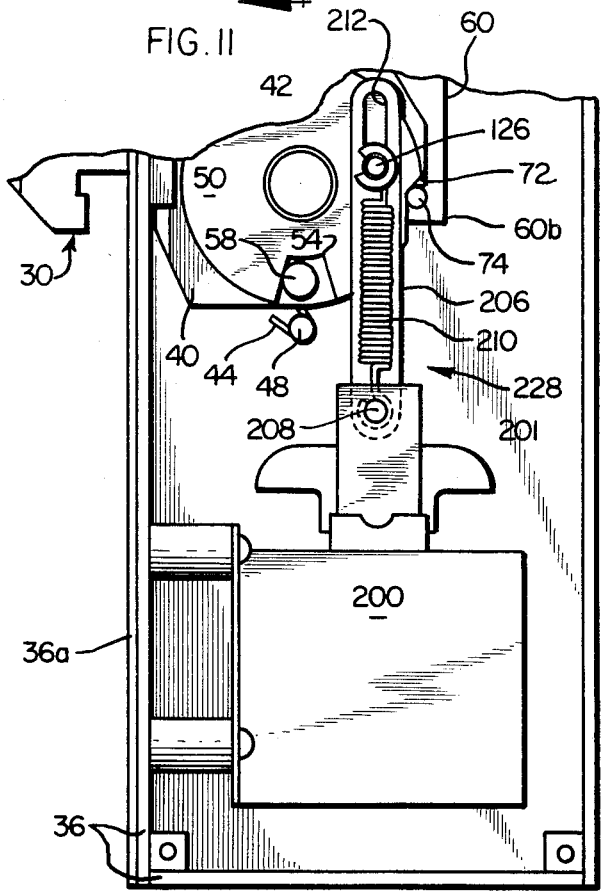
FIG. 11 is a view similar to FIG. 9, illustrating a solenoid operated lock mechanism in a fail-secure arrangement, in accordance with yet another embodiment of the invention.

As previously indicated, the motor 100 is remotely controllable from the controls of the remotely located control panel 22 of FIG. 1 for operating or rotating the disc 50 in this fashion and for returning to the position in FIG. 2 wherein the disc 50 and latch bolt 30 are allowed to return to the latched position. In this regard, and referring briefly to FIG. 11, the electical drive means may also comprise a solenoid 200 having a plunger 201 coupled to link means 228, which comprises a single link 206. A spring 210 similar to the spring 110 causes similar motion of the operating disc 50 for operating the latch bolt 30 in response to operation of solenoid 200. It will be noted in this regard, that the somewhat more complex structure of the link means 128 described with respect to FIGS. 2 through 8 is necessitated by the limited space available in the casing structure 36, which compels mounting of the motor 100 substantially in the orientation shown and provision of the link means or linkage assembly 128 as previously described. In contrast, the solenoid 200 may be mounted substantially directly below the pin or shaft 126 of operating disc 50 whereby the simplified linking structure including a link 206 and a spring 210 may be utilized. In this regard the link 206 is provided with an elongate slot 212 similar to slot 112. The configuration illustrated in FIG. 11 provides "fail-secure" operation of the lock, by which is meant that upon loss of electrical power, such that the solenoid 200 becomes de-energized, the latch bolt 30 will return to its latched position, under the biasing force of the spring 44.

Figure 8:
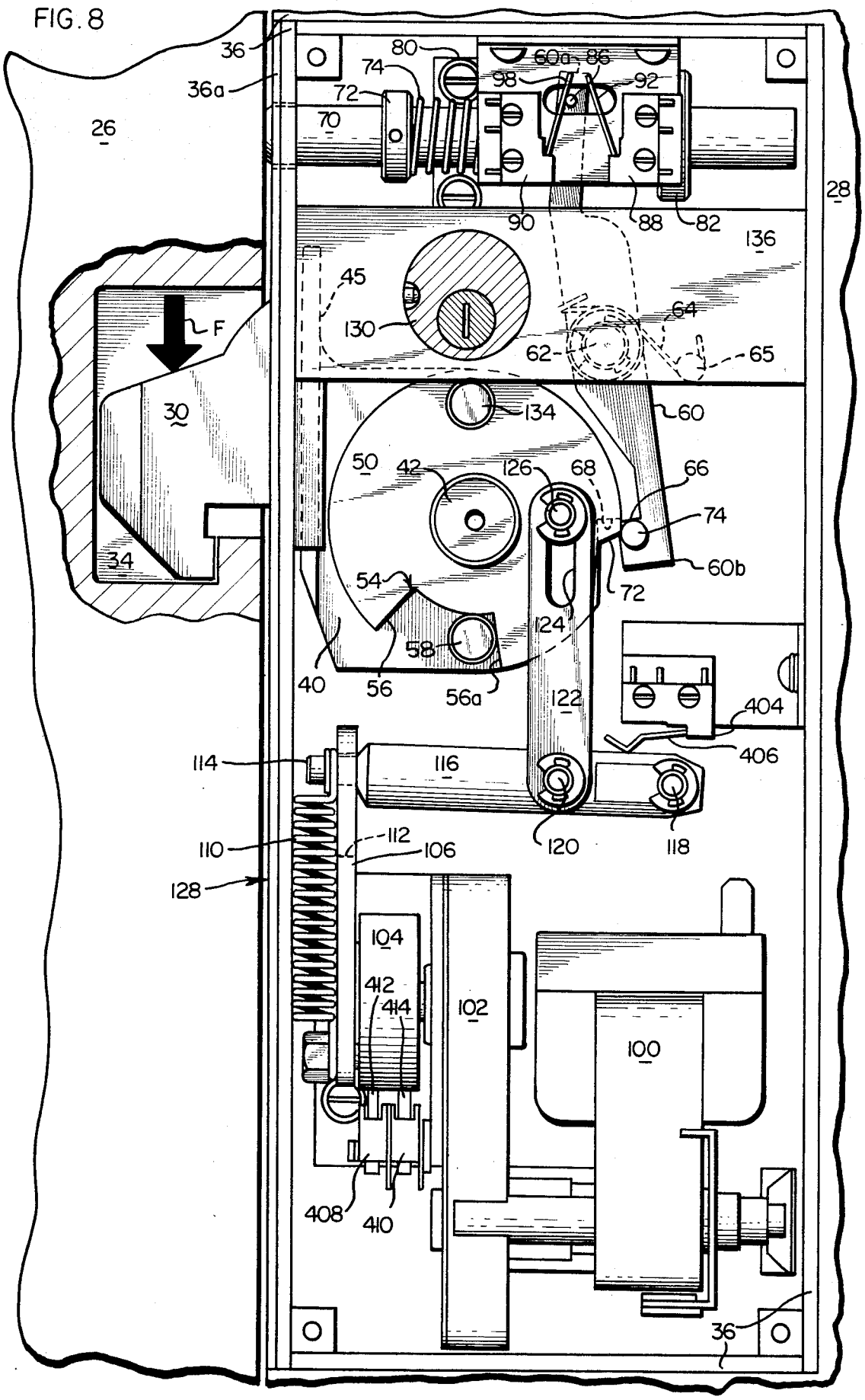
FIG. 8 is a view similar to FIGS. 2, 6 and 7, illustrating operation of the lock mechanism in response to an attempt to physically override such operation.

The springs 110 and 210 just described comprise yieldable means and the elongate slot 112 defines a lost motion connection with the operating lever end 114. A similar lost motion connection is provided by slot 212 in link 206 about pin 126 in the embodiment of FIG. 11. This yieldable means and lost motion type of connection prevent stalling of the electrical drive means such as the motor 100 or solenoid 200 in response to a force F applied to the latch bolt as illustrated for example in FIG. 8, in an attempt to prevent rotation thereof away from the latching position. Under such circumstances, as mentioned above, such an attempt to override the normal remotely controlled operation of the lock mechanism 20 may also be an attempt to give a false indication to the operator or the security officer of the condition of the lock. Such application of external force might otherwise cause damage or deformation to internal parts of a rigidly linked drive system. However, the yieldable spring 110 or 210 and lost motion connection provided by slots 112, 212 avoid such damage and permit the motor 100 or solenoid 200 to complete its normal operation without regard for external force preventing the normal corresponding retractive or unlatching operation of the latch 30. As shown in FIGS. 8 and 11, the springs 110, 210 may expand within the space provided by slots 112, 212 to permit motor rotation or solenoid operation in spite of the force F resisting corresponding latch bolt rotation.

In this latter regard, it will be recognized that the spring 110 or 210 comprises the actual operative member of the link means or link assembly 128, 228 for rotating the latch bolt 30 by way of disc 50. The associated link 106 or 206 acts as a guide or stabilizing means for the spring and related assembly during this operation, in addition to providing a lost motion correction.

A further operating means or control means for rotating the operating disc 50 is provided in the form of a key-rotatable lock cylinder assembly 130 as best viewed in FIGS. 3, 4 and 5. Means are provided operably coupling the lock cylinder 130 with the operating disc 50 such that rotation of the lock cylinder will provide the retractive movement or rotation of the latch bolt to the retracted or unlatched position. In this regard, the key-operated lock cylinder includes a tongue member 132 which operates in response to rotation of a mating key in lock cylinder 130 in a first or counter-clockwise direction as viewed in FIG. 5, for actuating a shaft or rod 134 which is rigidly mounted axially extending from the operating disc 50. In the embodiments illustrated, it is contemplated that only the correction officer or other authorized personnel would be provided with the key for rotating the lock cylinder 130 in the direction indicated in FIG. 5 for rotating the disc by way of shaft or rod 134.

It will also be noted that the lock cylinder 130 is mounted through a suitable through aperture (not shown) in a side surface or plate of the casing structure 36, and also through a suitable supporting strap or plate 136 which is mounted between opposed side walls of the casing structure 36 as best viewed in FIG. 2. In this regard, the lock cylinder 130 is preferably held securely in place by a recessed set screw 138 which is inserted through a recess 140 which extends through the mounting strap or plate 136 and is entered from the end surface of the casing structure 36 which is normally covered by the face plate 36*a*.

The lost motion connection defined by the slot 124 in the link 122 will be seen to permit or accommodate rotation of the disc 50 by the lock cylinder 130 independently of the electrical drive means or remotely controlled means such as the motor 100. In the embodiment of FIG. 11, the solenoid plunger 201 will return to its retracted position when the latch bolt and disc are rotated by the key-operated cylinder for unlatching. In this regard, the spring 210 normally holds the solenoid plunger 201 extended when the latch bolt is in the latched position. Hence, key operation of the lock is permitted for unlatching the latch bolt 30 with the motor 100 or solenoid 200 in the respective positions shown in FIGS. 2 and 11, which positions are the positions thereof normally associated with the latched position of the latch bolt 30.

Figure 9:
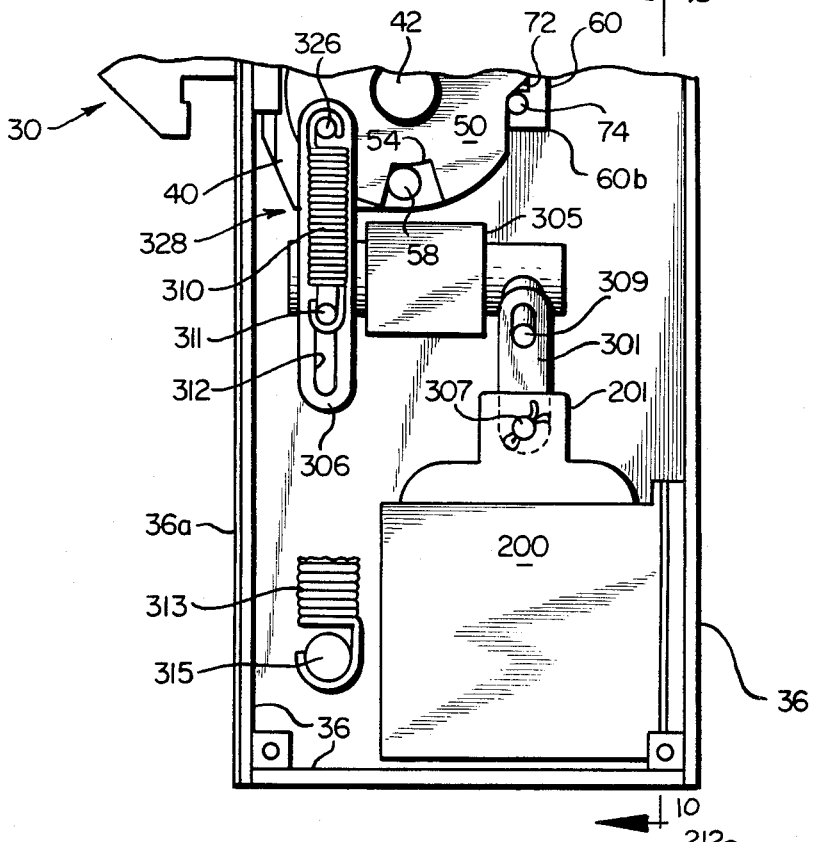
FIG. 9 is a broken-away side elevation of a lock mechanism, similar to FIG. 2, and illustrating solenoid control thereof in accordance with the second embodiment of the invention, and configured for fail-safe operation.
Figure 10:
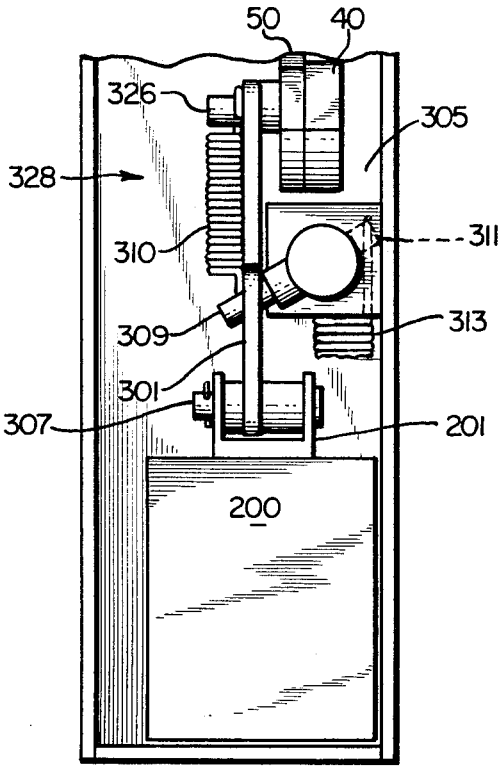
FIG. 10 is a view taken generally in the plane of the line 10—10 of FIG. 9.

Referring briefly also to FIGS. 9 and 10, an alternative link means or linkage arrangement is illustrated for fail safe type operation by the solenoid 200. This latter illustrated arrangement is such that upon loss of electrical power the solenoid will permit the latch bolt 30 to rotate to its retracted or unlatched position. In this regard, it will be noted that the operating shaft or pin 326 of operating disc 50 is repositioned with respect to operating disc 50 substantially 180 degrees removed from the relative positions of the shaft or pin 126 as shown in the previously described embodiments. A similar lost motion connection defined by a slot 312 in an elongate link member 306 and yieldable means in the form of a tension spring 310 are also provided for generally the same purpose and operation as described with reference to FIGS. 8 and 11 with respect to springs 110 and 210, links 106 and 206, and slots 112 and 212. That is, the structures permit operation of the solenoid even in the event of a force applied to the latch bolt 30 for preventing normal operation thereof to the unlatched or retracted position. The spring 310 will be seen to be expandable to accommodate rotation of the operating disc 50 by a key-operated lock cylinder in the direction for unlatching latch bolt 30.

In order to transmit the motion from the plunger 201 of solenoid 200 to the shaft 326, a linkage assembly or link means 328 is utilized, which includes the previously mentioned link 306 and spring 310. This linkage assembly 328 further includes a link 301 coupled intermediate the solenoid 200 and a shaft 303 which is rotatably mounted in a bearing block 305 coupled to a rear wall of the casing structure 36 as viewed in FIGS. 9 and 10. A pair of elongate pins 307, 309 are utilized for coupling upper and lower ends of the link 301 to the solenoid 200 and shaft 303, respectively.

Similarly, an elongate pin 311 extends through slot 312 and couples the lower end of the spring 310 with the shaft 303 at the end thereof opposite its coupling with the link 301. This latter pin 311 also extends through the opposite end of shaft 303 to receive a further elongate tension spring 313 whose opposite end is coupled to a fixed pin 315 therebelow. This spring 313 serves an analagous function to the coil spring 44 of the other embodiments, such a coil spring not being provided in the embodiment of FIGS. 9 and 10. In this regard, the spring 313 will be seen to normally urge the link 306 in a generally upward direction as viewed in FIGS. 9 and 10, tending to bias the disc and therefore the bolt 40 to the retracted or unlatched condition. Hence, the "fail-safe" feature of the embodiment of FIGS. 9 and 10 is accomplished essentially by the spring 313 when the solenoid 200 is without electrical power. That is, the solenoid 200 is utilized for normally actuating the latch bolt 30 to the closed or latched condition, in contrast to the operation of the other two embodiments wherein the motor 100 and solenoid 200, respectively, normally actuate the latch bolt to the unlatched or retracted condition, with the biasing springs 44, 244, normally biasing the latch bolt toward its closed or latched position.

Referring now also to FIG. 12, the electrical monitoring and control system for the motor 100 or solenoid 200 will next be described in greater detail. As previously mentioned, a first circuit portion 400 is remotely located, preferably at the control station or control panel 22, previously described. A second circuit portion 402 is located in the casing structure 36 with the lock mechanism 20, the two circuit portions 400 and 402 being joined by the wires or cables 24 as previously indicated. As also previously indicated, the control circuit portion 402 in the casing structure 36 comprises switching means for producing electrical signals indicative of the operation of the lock mechanism 20. In particular, this switching means comprises a plurality of switches which are positioned to be actuated by various portions of the mechanism previously described to provide such electrical signals, these electrical signals being utilized to monitor and control operation of the motor 100 or solenoid 200.

A first such switch 88, which was previously mentioned, is designated as the lock status switch, and has a movable contactor 96 positioned for actuation by the pin 86 at the end 60*a* of deadlock lever 60 when the deadlock lever 60 is in the blocking, engaged or deadlock position with respect to the latch bolt 30. This switch 88, as well as all the other switches to be described with reference to circuit portion 402 of FIG. 12 comprises a normally open contact and a normally closed contact indicated in FIG. 12 respectively as "NO" and "NC". Each of these switches also includes a movable contactor, such as contactor 96 normally biased into electrical engagement or contact with the normally closed (NC) contact and movable into electrical engagement or contact with the normally open (NO) contact.

The contactor 96 of switch 88 when not depressed by the pin 86 is with its normally closed (NC) contact which it will be seen completes a circuit from a source of electrical power V1 to a red (R) lamp 405 on the control panel, thus indicating that the deadlock lever 60 is in the non-blocking position with respect to latch bolt 30. On the other hand, when the deadlock lever moves to the blocking position, the contactor 96 of switch 88 will be depressed, thereby contacting the normally open terminal as shown in FIG. 12 and completing the circuit to a green lamp (G) 403 indicating that the deadlock lever is in the blocking or deadlocked position with respect to latch bolt 30.

A second switch 90, which was previously mentioned, is designated the trigger or hold back switch and is positioned for actuation by the pin 86 only when the trigger bolt 70 is in its fully extended position, that is, when the door 26 is open.

A further switch 404 (not shown in FIGS. 9 and 11) is designated as the safety switch, and referring to FIG. 2, is located in a position such that its movable contactor 406 will be depressed when the latch bolt 30 is in the latched condition. In the embodiment of FIG. 2, the switch 404 is located so that the movable contactor 406 thereof will be depressed by the operating lever 116 when the latch bolt 30 is in the latched condition. Advantageously in this regard, it will be noted that, should the latch bolt 30 be physically restrained (as shown in FIG. 8) from operating in response to the normal operation of motor 100 for effecting rotation thereof to the unlatched or retracted position, the movable contactor 406 of switch 404 will remain in its depressed condition. For example, in the embodiment of FIGS. 2–8, the spring 110 will elongate (as shown in FIG. 8) in response to the immobilized latch bolt 30 (and hence immobilized disc 50) holding the link 122 substantially unmoved, save for the movement permitted in the space 59 as previously described. Hence, movable contactor 406 remains depressed by the control lever 116. In similar fashion, the springs 210 and 310 in the embodiments of FIGS. 9 and 10 will also elongate, however, it will be noted that the respective links 206 and 306 will remain immobilized together with latch bolt 30 and operating disc 50, save for the movement permitted by space 59.

An additional pair of "position" switches 408 and 410 provide signals corresponding to the position of the cam 104 of FIG. 2 and hence of the motor, relative to the latched or unlatched condition of the latch bolt 30. In this regard, the switch 408 will be referred to hereinafter as the "latch" switch, while the switch 410 will be referred to hereinafter as the "unlatch" switch. Referring also to FIG. 3, it will be seen that the cam 104 mounts a pair of actuating members which here take the form of screws 140 and 142 whose bodies (not shown) are advanced into the cam 104 to leave the head portions thereof protruding. These screws or actuating members 140 and 142 are positioned substantially 180 degrees apart about the circumference of the generally circular cam 104.

As previously noted, FIG. 2 illustrates the mechanical locking structure 20 in a fully latched or locked position, that is, with latch 30 in its latched position and deadlock lever 60 in the blocking position. Accordingly, the motor 100, cam 104 and link means or assembly 128 are also illustrated in a position corresponding to the latched position of the latch bolt 30. It will be noted that in this position of the motor 100 and cam 104, the actuating member or screw 142 actuates or depresses the movable contactor 412 of the latch switch 408. Conversely, it will be noted that 180 degrees of revolution of the cam 104 will move the latch bolt 30 to the unlatch position, whereupon the other actuating means or screw 140 will actuate or depress the movable contactor 414 of the unlatch switch 410. Referring briefly to FIG. 12, it will be seen that the switches 408 and 410 generally comprise position switch means, which are coupled generally in circuit intermediate the drive means or motor 100 and a source of power V2 which preferably comprises a 110 VAC line, for generally controlling the flow of current to the drive means in a predetermined fashion in accordance with the positions of their movable contactors 412 and 414 and hence in accordance with the positions of the deadlock lever 60 and drive means or motor 100 and corresponding position of the cam 104 as described above.

Similar position switches (not shown) may be provided if desired for the solenoid 200 of FIGS. 9, 10 and 11 for indicating the fully extended and fully retracted position of the solenoid plunger 201.

The safety switch 404 will also be seen with reference to FIG. 12 to be included in circuit intermediate the 110 volt power source V2 and the normally open terminal of the unlatch switch 410. Hence, the safety switch, which is actuated when the latch bolt is in its first or latched position and deactivated when the drive means has moved the latch bolt to its second, retracted or unlatched position, applies energizing current to the position switch means comprising switches 410 and 412. Additionally, the hold back switch or trigger switch means 90 is responsive to the deadlock trigger 70 being in the extended position as previously mentioned for delivering energizing current to the position switch means comprising switches 410 and 412. In this regard, in FIG. 12 it will be seen that the trigger switch or hold back switch 90 is also interposed intermediate the power source V2 and the normally closed terminal of unlatch switch 410. Hence, the safety switch 404 is positioned essentially to detect a correspondence between the positions of the electrical drive means comprising (in the embodiment of FIG. 2) the motor 100 and the latch bolt 30.

Additionally, the remotely located control panel 22 includes as part of the first circuit portion 400 a door control switch 416 which preferably comprises a momentary contact toggle switch, having a movable contactor 418 normally biased into engagement with a normally closed terminal (NC) and movable by an operator such as a correction officer, into engagement with a normally open (NO) terminal. This door control switch is placed in circuit for remotely controlling operation of electrical drive means such as motor 100 or solenoid 200. In this regard, the movable contactor 418 is coupled to one side of the 110 VAC line V2 and the normally open terminal thereof is coupled to the normally open terminal of the latch switch 408. Hence, the latch switch 408 is coupled in electrical circuit intermediate the door control switch and the electrical drive means such as motor 100. It will be noted that the unlatch switch 410 is also coupled in series circuit intermediate the source of electrical power V2 and the latch switch 408, since the normally closed terminal of unlatch switch 410 is coupled directly to one side of the 110 VAC line V2 and the movable contactor 414 thereof is coupled to the normally closed (NC) terminal of latch switch 408.

A pair of additional switches may also be provided for inmate control of the unlatching of latch bolt 30. In this regard, a key-operated switch 420 is mounted to the plate 136, as best viewed in FIGS. 4 and 5. This switch 420 has a movable contactor 422 positioned to be actuated by the lock tongue member 132 when the lock cylinder is rotated generally in the counter-clockwise direction as viewed in FIG. 5. In this regard, the key given an inmate would be capable of rotating the lock cylinder 130 only in the counter-clockwise direction to actuate or depress the movable contactor 422 of switch 420.

Referring again to FIG. 12, it will be seen that the switch 420 is coupled in essentially parallel circuit configuration with a second switch 424. Both switches are coupled intermediate the 110 VAC line V2 and the latch switch 408 in similar fashion to door control switch 416. The switch 424, like the switch 420, has a movable contactor normally biased into engagement with a normally closed contact but movable into engagement with a normally open contact. This latter switch 424 preferably is placed inside of the cell or door 26 of FIG. 1 and hence is not seen in FIG. 1.

The inmate would then have the option of actuating this interior switch to unlatch the door from inside the cell or door 26. In either case, a further additional control switch 426 is provided at the control panel and essentially in series circuit intermediate the two switches 420 and 424 and the latch switch 408 for the motor or solenoid 100 or 200.

The switch 426 also has a movable contactor movable between a normally closed and normally open terminal, the movable contactor being coupled to one side of the 110 VAC line V2, and the normally open terminal being coupled with the movable contactors of both switches 420 and 424. Accordingly, it will be seen that the switch 426, accessible only to the correction officer, controls the flow of energizing current to both switches 420 and 424, and hence may be utilized to control use of either the inmate key-operated switch 420 or the interior cell switch 424 by the inmate for actuating the latch 30 to its open, retracted or unlatched position.

Referring now more particularly to the electrical connections described above with respect to FIG. 12 and the manner in which the various switches are positioned for actuation in the mechanical lock assembly of FIGS. 2 through 8, the electrical operation of the lock assembly will next be described. Initially referring to FIG. 2, with the lock assembly in the latched and deadbolted or blocked condition, the switches in FIG. 12 will all initially be in the condition as illustrated in FIG. 12. In order to unlatch the latch bolt and achieve the position thereof shown in FIG. 6, the correction officer may momentarily actuate contactor 418 of switch 416 to the normally open terminal thereof. Thereupon, electrical current is fed to the motor 100 by way of normally open terminal and the contactor 412 of latch switch 408. Hence, the motor 100 will begin to rotate, but after a few degrees rotation, the actuator member or screw 142 will release movable contactor 412 of switch 408, whereupon it will return into engagement with its normally closed (NC) terminal or contact. Thereafter, electrical current will continue to flow by way of the normally closed contact and movable contactor 414 of switch 410 and normally closed contact and movable contactor 412 of switch 408 to motor 100. Hence, the motor 100 will continue to rotate until the switch actuating member or screw 140 depresses the movable contactor 414 of the unlatch switch 410, thereby moving it into engagement with the normally open contact thereof. Motor rotation will cease at this point, with the assembly in the position illustrated in FIG. 6.

Figure 7:
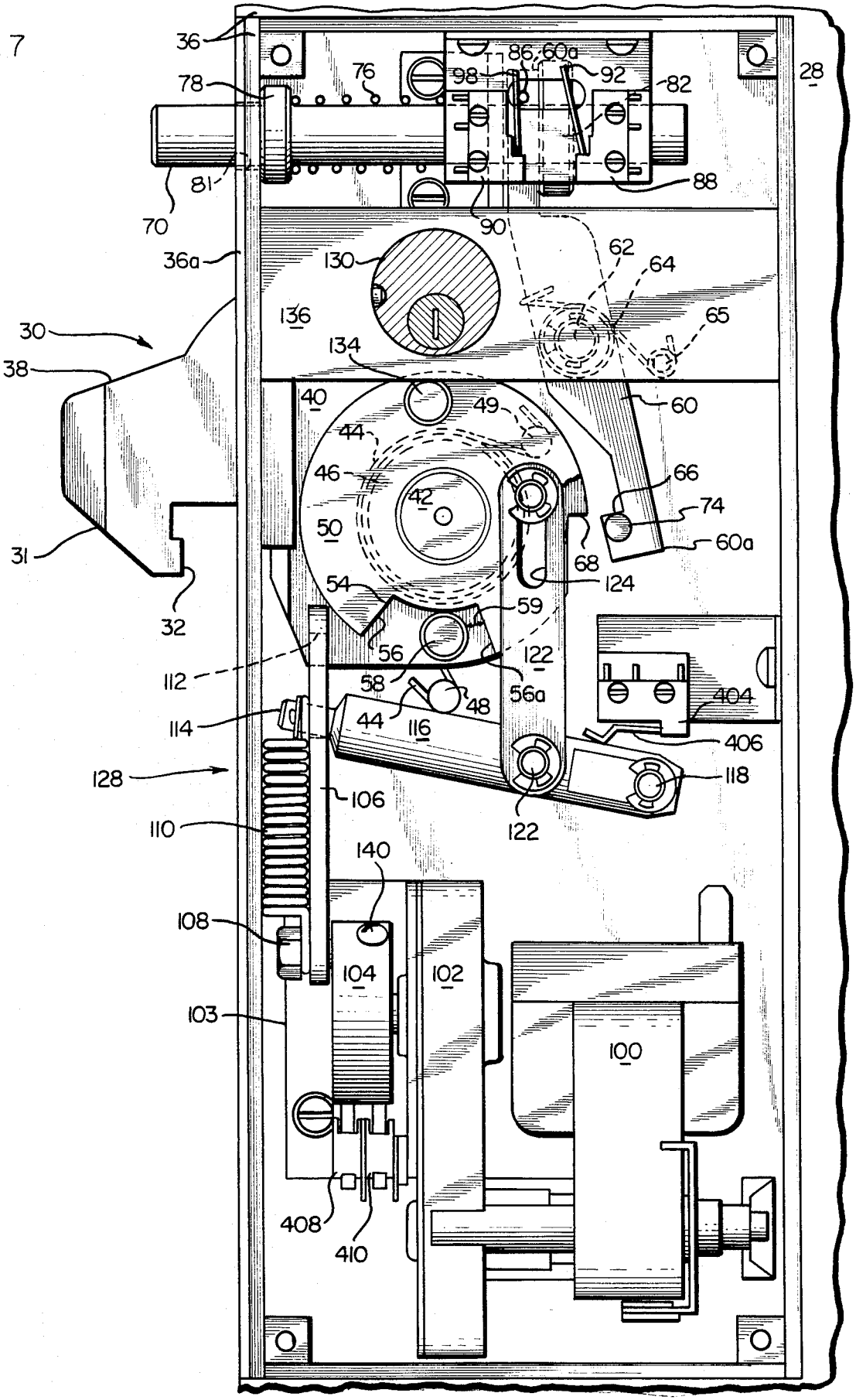
FIG. 7 is a view similar to FIGS. 2 and 6 and illustrating the door in an open condition and the lock in a partially latched or locked condition.

The door 26 may now be opened, releasing the deadbolt trigger 70 to its extended position. It will be noted that the foregoing rotation of motor 100 and corresponding movement of the cam 104 substantially 180 degrees and corresponding movement of the link means or assembly 128 will result in release of the movable contactor 406 of safety switch 404 to once again engage its normally closed contact. Moreover, initial camming-out of the deadlock lever 60 will release movable contactor 96 of switch 88 to once again engage its normally closed terminal thus energizing or lighting the red lamp 405. Thereafter, release of the trigger bolt at 70 as illustrated in FIG. 7, upon opening of the door, will cause the deadlock lever actuating pin 86 to depress the movable contactor 98 of switch 90 into contact with its normally open terminal. Referring again to FIG. 12, electrical current will now be supplied by way of the movable contactor 98 and normally open terminal of the hold back or trigger switch 90 to the normally open terminal and movable contactor 414 of unlatch switch 410 and thence to the normally closed contact and movable contactor of latch switch 412 to once again energize the motor 100.

Upon initial rotation of the motor a few degrees, it will be noted that the actuator 140 will again release the movable contactor 414 of the unlatch switch 410 which will then return to engage the normally closed contact thereof. Thereupon, the electrical current will proceed by way of the circuit from the normally closed contact through the movable contactor 414 of switch 410 to the normally closed contact and movable contactor 412 of switch 408 to continue to rotate the motor. The motor will then rotate until actuator member 142 again depresses movable contactor 412 of switch 408 back into contact with the normally open terminal thereof to again cut off power to the motor.

At this point, the lock mechanism will be in the condition illustrated in FIG. 7, with the door still open and the latch in the latched position, and deadlock lever retracted to the non-blocking position, whereby the latch may be re-engaged in the door 26 by sliding the door towards the latch and letting the latch retract against spring biasing 44 as tapered leading edge 31 thereof engages the edge of the opening 34 in door 26. It will be noted that the lost motion connection previously described with reference to slot 124 permits this momentary retraction of latch bolt 30 to engage the opening 34.

Hence, upon closing the door, the lock mechanism will return to the condition illustrated in FIG. 2, with the trigger bolt 70 now fully recessed again releasing the deadlock lever 60 to the blocking condition with respect to the latch bolt 30. Accordingly, the electrical circuit will again return to the condition illustrated in FIG. 12. Alternatively, it now will be seen that similar operation of the motor 100 for initially unlatching the door to permit opening thereof and thereafter automatically rotating to place the latch bolt 30 in the latched condition may be had by actuating either of the switches 420 or 424 to their normally open contacts, when the switch 426 is engaged with its normally open contact to provide electrical power thereto. It will be appreciated, however, that once the door opens, the release of the deadlock trigger 70 will depress the movable contactor 98 of trigger or hold back switch 90 into contact with its normally open terminal to initiate a further 180 degrees revolution of the motor for returning the latch bolt 30 to its latched condition.

Referring again to FIG. 8, an attempt to override operation of the motor by applying pressure to the latch bolt 30 will fail to cause any damage to the motor because of the action of the spring 110 and lost motion connection provided by slot 112 of link 106 as previously described, as well as the equivalent structure described with reference to the embodiments of FIGS. 9 and 11. However, the safety switch 404 (FIG. 8) also assures that the motor will continue to rotate back to its position for normally placing the latch 30 in its down or latched condition. As shown in FIG. 8, with pressure applied to the latch, rotation of the motor for extending the spring will fail to move the control lever 116 out of contact with movable contactor 406 of switch 404.

Hence, referring to FIG. 12, the movable contactor 406 of switch 404 will continue to complete a circuit by way of its normally open terminal from the 110 VAC line V2 to the normally closed contact 414 of the unlatch switch 410. It will also be noted that with the motor in the condition shown in FIG. 8, the movable contactor 414 will be depressed, that is in contact with the normally open terminal of switch 410 and the movable contactor 412 will be undepressed, that is, in contact with the normally closed terminal of switch 408. Hence, the motor will be energized by way of switches 404, 410 and 408. Upon initial rotation a few degrees of the motor 100, the actuator member or screw 140 will again release movable contactor 414 of switch 410 to again engage its normally closed terminal which it will be remembered is coupled to one side of the 110 VAC line V2. Hence, power will continue to be supplied to the motor by way of switches 410 and 408 until the motor rotates a full 180 degrees causing the movable contactor 412 of switch 408 to be actuated by the actuator 142 back into contact with its normally open terminal, cutting off the power supply to the motor.

It will also be noted that depression of the trigger bolt 70 while the door is open will cause release of the movable contactor 98 of the hold back or trigger switch 90 to engage its normally closed terminal, thus possibly preventing automatic operation of the motor as previously described for again rotating the latch bolt 30 to the latched condition upon opening of the door 26. However, it will be noted that this depression will fail to cause actuation of switch 88 by the deadlock trigger, which is held out of contact with movable contactor 96 by the open latch bolt 30 and disc 50 as shown in FIG. 6 for example. Hence, the red lamp 405 will continue to be energized even when the door is closed, indicating to the correction officer the failure of the door to properly latch and deadlock. Hence, the correction officer should see to it that the door be partially re-opened to allow extension of the trigger bolt to cause the rotation of the motor 100 for rotating the latch bolt 30 back to its latch position.

Alternatively, an additional reset switch 430 may be provided at the control panel 22 for causing resetting of the latch bolt 30 to its latch position without the necessity of releasing trigger bolt 70 to the extended position. This further reset switch 430 is preferably depressed to its normally open contact until the green lamp 403 again is energized indicating return of the deadlock lever 60 to the blocking position, which can only be accomplished upon rotation of the latch bolt 30 to its latched position. It will be seen that the switch 430 has a movable contactor coupled to one side of the 110 VAC line V2 and a normally open contact coupled to the normally open contact of unlatch switch 410 in common with the normally open contacts of respective switches 90 and 404. This switch 430 permits latching of the latch bolt 30 following unlatching thereof without opening the door, for example going directly from the position shown in FIG. 6 to that shown in FIG. 2. This is advantageous when the inmate wishes to remain in the cell or room after unlatching of the door but does not wish other inmates to enter. This feature is also useful any time it is desired to re-latch the door (after unlatching) entirely from the remote control panel 22, without the necessity of physically opening the door.

What has been illustrated and described herein is an improved locking system and lock mechanism for a security installation. While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A lock mechanism including a casing structure adapted to be mounted to one of a door and door frame and having a front plate with an aperture therein; a latch bolt mounted with respect to said casing structure for movement between a first position for latching engagement with the other of said door and door frame, and a second, retracted position wherein said latch bolt is held out of position from said latching engagement; a deadlock member mounted to said casing for movement between a blocking position wherein said deadlock member will prevent movement of the latch bolt to said second, retracted position, and a non-blocking position wherein said latch bolt is free to move to said retracted position; an operating disc comprising a relatively thin, generally circular, generally disc-shaped plate having a center and mounted for rotation about its said center and also operatively coupled to move said latch bolt through a lost motion type of connection; and control means for effecting selective movement of said operating disc to move said latch bolt to the retracted position, with the initial rotation of said operating disc resulting in the movement of the deadlock member to the non-blocking position, with said lost motion connection delaying movement of said latch bolt until said deadlock is moved from the blocking position; wherein said latch bolt and said operating disc are coaxially, rotatably mounted.

2. A lock mechanism according to claim 1, further including a biased deadlock trigger mounted for movement with respect to said casing structure front plate between an extended position and a retracted position relative to said front plate, said front plate having a further aperture through which an outer end part of said biased trigger extends when in said extended position; said deadlock member comprising an elongate deadlock lever having a central portion pivotally mounted with respect to said casing and including a first end portion adjacent said deadlock trigger for operation thereby, and second, opposite end portion adjacent said latch bolt, such that when said trigger is in the extended position the deadlock lever is urged to a position whereby said second end portion is in the non-blocking position with respect to said latch bolt, with movement of the trigger to the retracted position freeing said deadlock lever for movement of said second end portion to the blocking position.

3. A lock mechanism according to claim 2, wherein the axis of rotation of said latch bolt and said operating disc and the pivot axis of said deadlock lever are disposed substantially parallel to said casing front plate.

4. A lock mechanism according to claim 2, wherein said operating disc includes a cam surface and wherein said deadlock lever is spring biased toward the blocking position and includes a cam follower means thereon disposed for engagement by said cam surface, such that during the initial movement of said operating disc to move said latch bolt to the retracted position said cam surface will engage said cam follower means to overcome the force on said deadlock lever created by the spring bias thereon, thereby to move said deadlock lever to the non-blocking position with respect to the latch bolt.

5. A lock mechanism according to claim 4, wherein said first end portion of said deadlock lever is positioned to be engaged by said trigger when in the extended position thereby urging said deadlock lever to cause said second end portion thereof to move to the non-blocking position, with retraction of said trigger freeing said deadlock lever such that the spring bias thereof will move said deadlock lever to the blocking position with respect to the latch bolt.

6. A lock mechanism according to claim 1, further including switch means carried by said casing and adapted for use with a monitoring circuit, or the like, to provide an indication of the condition of said lock.

7. A lock mechanism according to claim 6, said switch means including at least one switch positioned to be operated by said deadlock lever to indicate whether said deadlock lever is in the blocking or non-blocking position.

8. A lock mechanism according to claim 1 wherein said control means comprises a key-operated lock cylinder and means operatively coupling said lock cylinder to move said operating disc in a direction for moving said latch bolt to the retracted position.

9. A lock mechanism according to claim 1 wherein the operating disc overlies a portion of the latch bolt coaxially mounted therewith, and wherein said lost motion type of connection therebetween comprises a generally arcuate cutout section in said operating disc and a protruding pin extending from a surface of said latch bolt and into said arcuate cutout section, the arcuate extent of said cutout section being greater than the diameter of said pin, said arcuate cutout section defining an abutment surface for selective contact with said pin for rotating the latch bolt, and said arcuate cutout section being positioned relative to said pin upon coaxial mounting of the disc and latch bolt, such that a predetermined amount of rotation of said disc is permitted prior to engagement of said abutment surface with said protruding pin.

10. A lock mechanism according to claim 2 wherein said control means comprises electrical drive means mounted within said casing structure and operatively coupled for moving said operating disc in the direction for moving the latch bolt to the second position, and electrical control circuit means including a first circuit portion within said casing structure and a second circuit portion at a remote security location, said electrical drive means being responsive to predetermined signal conditions of said first and second circuit portions for rotating said operating disc only in response to the simultaneous existence of predetermined signal conditions of both of said first and second circuit portions.

11. A lock mechanism according to claim 10 wherein said electrical drive means comprises a solenoid.

12. A lock mechanism according to claim 10 wherein said electrical drive means comprises an electrical motor.

13. A system according to claim 10 wherein said second circuit portion comprises remotely located control means selectively actuatable for providing energizing current for said drive means; and wherein said first circuit portion includes position switch means responsive to the position of said drive means for controlling the flow of energizing current to said electrical drive means in a predetermined fashion in accordance with the position thereof.

14. A system according to claim 13 wherein said first circuit portion means further includes safety switch means responsive to said electrical drive means and said latch means for actuation when the latch bolt is in its first position, and de-actuation when the drive means has moved the latch bolt to its second position; said safety switch means when actuated applying said energizing current to said position switch means.

15. The system according to claim 14 and further including trigger switch means responsive to the said deadlock trigger being in the extended position for delivering energizing current to said position switch means.

16. A lock mechanism including a casing structure, a spring biased rotatably mounted latch bolt urged to one of a predetermined latching position and a predetermined unlatching position with respect to said casing structure, and operating means for effecting rotation of said latch bolt to the other of said predetermined latching and unlatching positions; said operating means including, disc means comprising a relatively thin, generally circular, generally disc-shaped plate having a center and mounted for rotation about its said center and also operatively coupled with said latch bolt, key-rotatable lock cylinder means, means operably coupling said lock cylinder means with said disc means such that rotation of said lock cylinder means will provide said rotation of said latch bolt to said other position, link means operable coupled to said disc means by a lost motion type of connection, and remotely controllable means for operating said link means for effecting rotatable movement of said disc means to effect said rotation of said latch bolt to said other position, said lost motion connection accommodating rotation of said disc means by said lock cylinder means independently of said remotely controllable means; wherein said link means includes both a yieldable, resilient spring-like portion, and means for defining a second lost motion type of connection, interposed intermediate said electrical drive means and said disc means for substantially preventing stalling of said electrical drive means in response to external force applied to said latch bolt for preventing said rotation thereof to said other position.

17. A lock mechanism according to claim 16 wherein said remotely controllable means includes electrical drive means mounted in said casing structure and coupled with said link means for effecting said rotatable movement of said disc means, and electrical control circuit means for operating said electrical drive means.

18. A lock mechanism according to claim 16 wherein said electrical drive means comprises an electrical motor mounted within said casing structure, and further including a cam rotated by said motor; and wherein said link means includes at least one elongate link member coupled intermediate said cam and said disc; said lost motion connection comprising an elongate slot in one end of said elongate link remote from said cam, and said yieldable means including a tension spring member operatively coupled between said cam and said disc; said spring member being operatively coupled for rotating said disc in one direction and said elongate link member being coupled generally in parallel with said tension spring member; and wherein said disc is operatively coupled for rotating said latch bolt toward one of said latching position and said unlatching position.

19. A lock mechanism according to claim 16 wherein said electrical drive means comprises a solenoid mounted within said casing structure; and wherein said link means includes at least one elongate link member having respective ends operatively coupled with said solenoid and said disc; said lost motion connection comprising an elongate slot in said link member, extending from a point adjacent an end of said elongate link member remote from the end thereof coupled with said disc, and said yieldable means including a tension spring member operatively coupled between said solenoid and said disc and generally in parallel with said link member; said spring member being operatively coupled for rotating said disc in a direction for rotating said latch bolt to said other position; and wherein said disc is operatively coupled for rotating said latch bolt to said other position.

20. A locking mechanism according to claim 19 wherein said tension spring member is coupled with a given location on said disc, and further including spring means providing the spring bias for the latch bolt and also coupled to said spring tension member, for together rotating said latch bolt away from the latching position in the event of loss of electrical power to said solenoid.

21. A lock mechanism according to claim 19 wherein said tension spring member is coupled between said solenoid and a given location on said disc for permitting rotation of said latch bolt to the latching position in the event of loss of power to said solendid.

22. A lock mechanism according to claim 16 wherein said latch bolt and said operating disc means are coaxially, rotatably mounted, and wherein said lost motion type of connection therebetween comprises a generally arcuate cutout section is said operating disc means and a protruding pin extending from a surface of said latch bolt and into said arcuate cutout section, said arcuate cutout, section defining an abutment surface for selective contact with said pin for rotating the latch bolt, the arcuate extent of said cutout section being treater than the diameter of said pin, and said arcuate cutout section being positioned relative to said pin upon coaxial mounting of the disc means and latch bolt, such that a predetermined amount of rotation of said disc means is permitted prior to engagement of said abutment surface with said protruding pin.

23. A lock mechanism including a casing structure adapted to be mounted to one of a door and a door frame and having a front plate with an aperture therein; a latch bolt mounted with respect to said casing structure for movement between a first position for latching engagement with the other of said door and door frame, and a second, retracted position wherein said latch bolt is held out of position from said latching engagement; a deadlock member mounted to said casing for movement between a blocking position wherein said deadlock member will prevent movement of the latch bolt to said second, retracted position, and a non-blocking position wherein said latch bolt is free to move to said retracted position; an operating disc comprising a relatively thim, generally circular, generally disc-shaped plate having a center and mounted for rotation about its said center and also operatively coupled to move said latch bolt through a lost motion type of connection; and control means for effecting selective movement of said operating disc to move said latch bolt to the retracted position, with the initial rotation of said operating disc resulting in the movement of the deadlock member to the non-blocking position, with said lost motion connection delaying movement of said latch bolt until said deadlock is moved from the blocking position; wherein said control means comprises electrical drive means mounted within said casing structure and operatively coupled for moving said operating disc in the direction for moving the latch bolt to the second position, and electrical control circuit means including a first circuit portion within said casing structure and second circuit portion at a remote security location, said electrical drive means being responsive to predetermined signal conditions of said first and second circuit portions for rotating said operating disc only in response to the simultaneous existence of predetermined signal conditions of both of said first and second circuit portions; wherein said second circuit portion comprises remotely located control means selectively actuatable for providing energizing current for said drive means; wherein said first circuit portion includes position switch means responsive to the position of said drive means for controlling the flow of energizing current to said electrical drive means in a predetermined fashion in accordance with the position thereof; and wherein said first circuit portion means further includes safety switch means responsive to said electrical drive means and said latch bolt for actuation when the latch bolt is in its first position, and de-actuation when the drive means has moved the latch bolt to its second position; said safety switch means when actuated applying said energizing current to said position switch means.

24. An electrically operated lock system comprising a lock mechanism including a casing structure; a latch bolt movable between a predetermined latching position with respect to said casing structure, and a second, non-latching position; a deadlock member mounted to said casing for movement between a blocking position wherein said deadlock member will prevent movement of the latch bolt to said non-latching position, and a non-blocking position wherein said latch bolt is free to move to said non-latching position; an operating member coupled to operate said latch bolt through a lost motion type of connection; electrically operated drive means for effecting selective movement of said operating member to move said latch bolt to the retracted position, with the initial movement of said operating member resulting in the movement of the deadlock member to the non-blocking position, with said lost motion connection delaying movement of said latch bolt until said deadlock is moved from the blocking position; and electrical circuit means for controlling operation of said electrical drive means for movement of said operating member; wherein said circuit means includes sensing means carried in said casing and adapted to provide electrical signals indicative of the condition of said lock mechanism; and wherein said sensing means comprises a latch switch and an unlatch switch respectively positioned to be actuated by said electrical drive means when said electrical drive means is respectively in a first position wherein said latch bolt is free to move to said latching position and in a second position wherein said drive means is in a position for normally moving said latch bolt to said non-latching position; said sensing means further including a safety switch disposed for detecting correspondence between the position of said electrical drive means and said latch bolt; said circuit means further including a remotely located door control switch for remotely controlling operation of said electrical drive means.

25. A system according to claim 24 wherein said door control switch is coupled in series circuit with a source of electrical power, and wherein said latch switch is coupled in electrical circuit intermediate said door control switch and said electrical drive means.

26. A system according to claim 25 wherein said unlatch switch is coupled in electrical circuit intermediate said source of electrical power and said latch switch.

27. A system according to claim 26 wherein said safety switch is coupled in electrical circuit intermediate said source of electrical power and said unlatch switch.

28. A system according to claim 24 and further including a lock status switch located in said housing for actuation by said deadlock lever only when said deadlock lever in in the blocking position and coupled in circuit for giving a first indication when actuated and a second indication when not actuated by said deadlock lever.

29. A system according to claim 24 and further including a biased deadlock trigger mounted for movement with respect to said casing structure between an extended position and a retracted position, said deadlock member comprising a deadlock lever pivotally mounted with respect to said casing and including a first end portion operatively associated with said deadlock trigger, and a second end portion operatively associated with said latch bolt, such that when the trigger is in the extended position the deadlock lever is urged to a position whereby said second end portion is in the non-blocking position with respect to said latch bolt, with movement of the trigger to the retracted position freeing said deadlock lever for movement of said second end portion to the bolcking position; and hold back switch means including a normally open contact, a normally closed contact and a movable contactor biased into contact with the normally closed contact, said movable contactor being positioned for actuation into contact with said normally open contact in response to the first end portion of said deadlock lever when said deadlock trigger is in the extended position.

30. A system according to claim 24 and further including a lock status switch located in said housing for actuation by said deadlock lever first end only when said deadlock lever is in the blocking position and coupled in circuit for giving a first indication when actuated and a second indication when not actuated by said deadlock lever first end portion.

31. A system according to claim 29 and further including a key-operated switch mounted in said casing structure for actuation by a key operated from a side of said lock mechanism normally positioned at an outer side of an associated door; a security switch normally located at an inner side of the door with which said lock mechanism is associated and located in a parallel circuit arrangement with said key-operated switch; and a remotely located control switch interposed between said source of electrical power and both said key-operated switch and said security switch for selectively providing electrical power thereto, said key-operated switch and said security switch being coupled in series circuit intermediate said remotely located control switch and said normally open contact of said latch switch.

32. A system according to claim 31 wherein each of said latch, unlatch, door control and safety switches includes a normally open contact and a normally closed contact and a movable contactor biased to engage said normally closed contact and movable to engage said normally open contact.

33. A system according to claim 32 wherein the movable contactor of said door control switch is coupled to a source of electrical power and the normally open contact thereof is coupled to the normally open contact of said latch switch, the movable contactor of said latch switch being coupled with said electrical drive means.

34. A system according to claim 33 wherein the normally closed contact of said unlatch switch is coupled to said source of power and the movable contactor thereof is coupled to the normally closed contact of said latch switch.

35. A system according to claim 34 wherein each of said key-operated switch, said security switch, and said remotely located switch includes a normally open contact, a normally closed contact and a movable contactor biased into engagement with said normally closed contact and movable into engagement with said normally open contact; the normally open contacts of said security switch and said key-operated switch being coupled with said normally open contact of said unlatch switch and the movable contactors of said key-operated switch and said security switch being coupled with the normally open contact of said remotely located control switch, the movable contactor of said remotely located control switch being coupled to said source of electrical power.

36. A system according to claim 34 wherein the normally open contact of said safety switch is coupled to the normally open contact of said unlatch switch and wherein the movable contactor of said safety switch is coupled to the source of electrical power.

37. A system according to claim 36 wherein the normally open contact of said hold back switch is coupled with the normally open contact of said unlatch switch and wherein the movable contactor of said hold back switch is coupled with said source of electrical power.

* * * * *